US005598606A

United States Patent [19]

Jacobs

[11] Patent Number: 5,598,606

[45] Date of Patent: Feb. 4, 1997

[54] BOTTOM SLIDE FOR DOORS

[75] Inventor: Kenneth Jacobs, Guildford, England

[73] Assignee: The Stanley Works, New Britain, Conn.

[21] Appl. No.: 601,709

[22] Filed: Feb. 15, 1996

[51] Int. Cl.[6] ..... A47H 15/00; E05D 15/00

[52] U.S. Cl. ..... 16/93 R; 16/105; 49/404

[58] Field of Search ..... 16/93 R, 93 D, 16/97, 99, 105, 32, 33; 49/404, 410, 411

[56] References Cited

U.S. PATENT DOCUMENTS

| | | | |
|---|---|---|---|
| 1,971,098 | 8/1934 | Disbro et al. . | |
| 1,985,298 | 12/1934 | Prince . | |
| 2,015,270 | 9/1935 | Henry . | |
| 2,049,394 | 7/1936 | Johnson . | |
| 3,005,226 | 10/1961 | Werner | 16/93 R |
| 3,261,129 | 7/1966 | Brydolf et al. | 16/93 R |
| 3,671,997 | 6/1972 | Sigmund | 16/93 R |
| 3,745,706 | 7/1973 | Stermac | 16/93 R |
| 4,069,617 | 1/1978 | Koike . | |
| 4,123,874 | 11/1978 | Scott | 49/411 |
| 4,391,019 | 7/1983 | Downes | 16/105 |
| 4,850,145 | 7/1989 | McAfee | 49/404 |
| 4,984,332 | 1/1991 | Bienert et al. | 16/93 R |

*Primary Examiner*—Chuck Y. Mah
*Attorney, Agent, or Firm*—Pepe & Hazard

[57] ABSTRACT

A bottom door slide includes a bracket having mounting portions for mounting on a door and providing a channel opening at the lower end of the bracket. Slidably seated in the channel of the bracket is a slide guide having a guide portion extending below the bracket and having a lower end adapted to extend within an upwardly opening channel of an associated floor track. The guide portion provides a mounting recess spaced upwardly from the lower end in which is seated a slide block having an arcuate upper surface abutting the upper surface of the mounting recess and a lower surface adapted to ride on the upper end of the floor track. The slide block is slidable on the upper surface of the recess to align itself on the upper end of the floor track.

17 Claims, 4 Drawing Sheets

BOTTOM SLIDE FOR DOORS

BACKGROUND OF THE INVENTION

The present invention relates to sliding door guides, and, more particularly, to a bottom door slide for guiding a sliding door along a floor track.

Door guides are provided at the bottom of sliding doors to control their motion and to carry at least a portion of the weight of the door thereon as the door slides back and forth along a floor track. For aesthetic purposes, it is common to attempt to align the door so that it hangs parallel to the jambs for the framed opening in which the door is disposed. This frequently results in some variation in spacing between the bottom edge of the door and the floor track along the length of the door, either as a result of misalignment of the jambs or sloping of the floor. Moreover, there is sometimes a variation in the floor surface even over the short distance of the width of the track which must be accommodated if the guide is to move smoothly along the upper edges of the track.

Moreover, it is quite common to employ a bracket structure for the door bottom guide which will also serve the function of joining the stile and bottom rail of the door frame to minimize the number of parts required and to facilitate assembly. In this instance, it is desirable that the slide guide which would normally project below the door be of a type which utilizes a component that could be assembled into the bracket after shipment of the door, and immediately prior to installation.

It is also an object to provide such a bottom door slide which can be fabricated readily and economically, and which provides smooth sliding movement on a floor track.

Another object is to provide such a bottom door slide with a projecting slide component which can be assembled quickly on site at the time of installation of the door.

SUMMARY OF THE INVENTION

It has now been found that the foregoing and related objects may be readily attained in a bottom door slide which includes a bracket having mounting portions for mounting on the door and providing a channel opening at the lower end of the bracket. A slide guide is slidably seated in the channel of the bracket and has a guide portion extending below the bracket. Its lower end is adapted to extend within an upwardly opening channel of an associated floor track, and the guide portion provides a mounting recess spaced upwardly from the lower end. Mounted in the recess is a slide block having an arcuate upper surface abutting the upper surface of the mounting recess and a lower surface adapted to ride on the upper edges of the floor track. The slide block is slidable on the upper surface of the recess to align itself on the upper end of the floor track.

In the preferred embodiments, the upper surface of the recess is arcuate, and the block is slidable both horizontally and transversely of the slide guide to enable alignment in a direction transversely of the track and in a direction longitudinally of the track. To do so, the upper surface of the block is arcuate along orthogonal axes.

Desirably, the upper surface of the recess is arcuate along one horizontal axis of the slide guide and the slide guide, provides bearing surfaces for the slide block in an axis perpendicular to the horizontal axis to enable pivoting of the slide block in orthogonal directions.

Preferably, the slide block is generally C-shaped, and the slide block and slide guide are cooperatively configured to permit the block to be inserted horizontally into the recess.

Desirably, the slide block is fabricated from a synthetic resin exhibiting low friction.

In the preferred embodiments, there is included means on the slide guide and bracket for retaining the slide guide in the channel. In addition, there is included means for adjustably spacing the slide guide vertically in the channel relative to the bracket.

BRIEF DESCRIPTION OF THE ATTACHED DRAWINGS

DETAILED DESCRIPTION OF THE PREFERRED EMBODIMENTS

Figure 1:
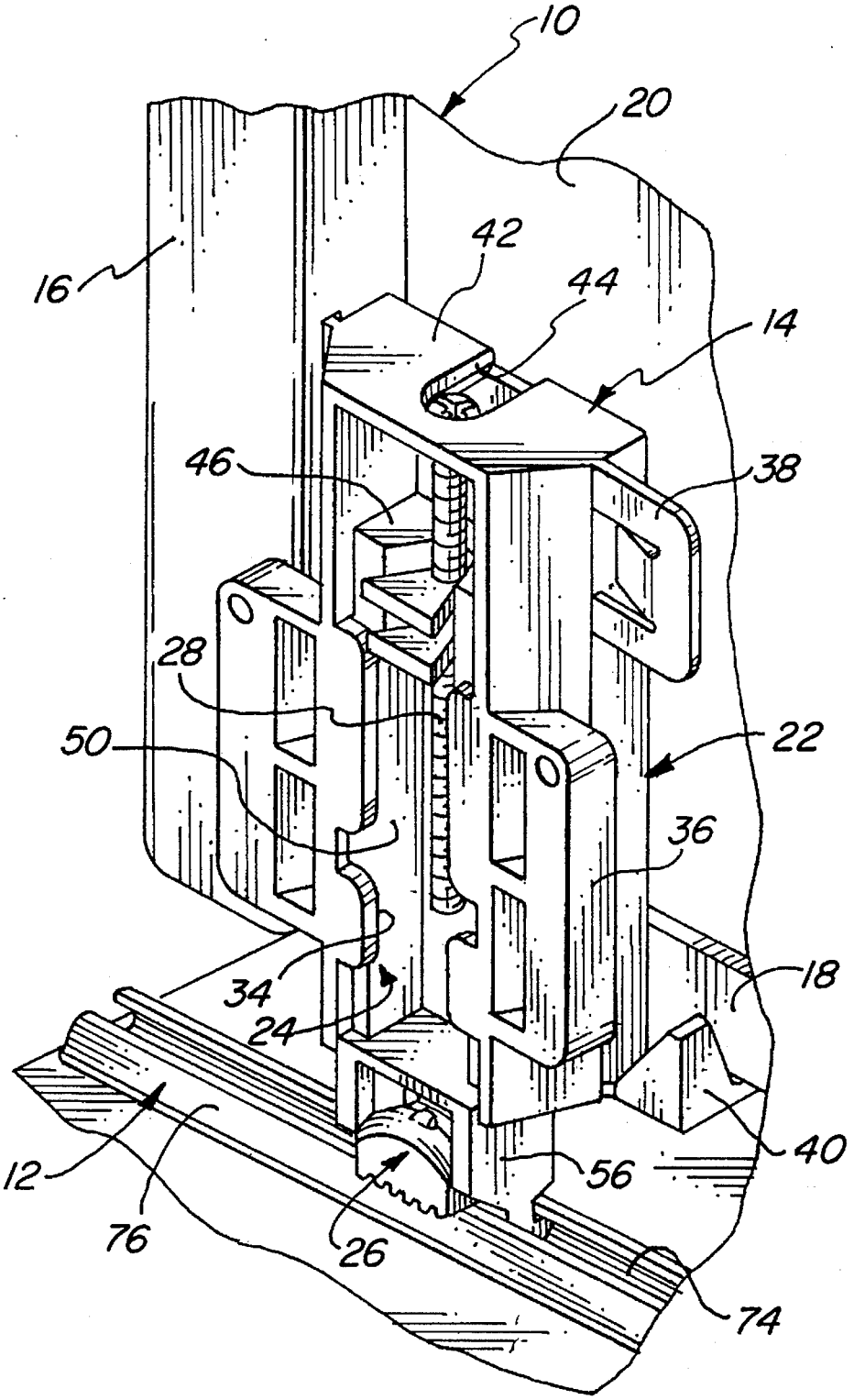
FIG. 1 is a fragmentary perspective view of a door assembly embodying the bottom door slide of the present invention.

Turning first to FIG. 1, therein fragmentarily illustrated is a door installation employing the bottom slide of the present invention. As seen, the door bottom slide of the present invention is generally designated by the numeral 14 and is mounted upon the door generally designated by the numeral 10. The slide 14 guides the door along the track generally designated by the numeral 12. In this particular instance, the door 10 is a mirrored door in which the mirror panel 20 is seated in channels in the stiles 16 and rails 18 which form the perimeter frame of the door.

Turning now in detail to the structure of the door bottom slide, the bracket is generally designated by the numeral 22 serves the dual purpose of supporting the slide guide 24 and coupling the stiles 16 and rail 18. Slidably seated in the bracket 22 is the slide guide generally designated by the numeral 24, and a slide block generally designated by the numeral 26 is seated therein adjacent its lower end. An adjusting screw 28 completes the components of the bottom slide 14.

Figure 2:
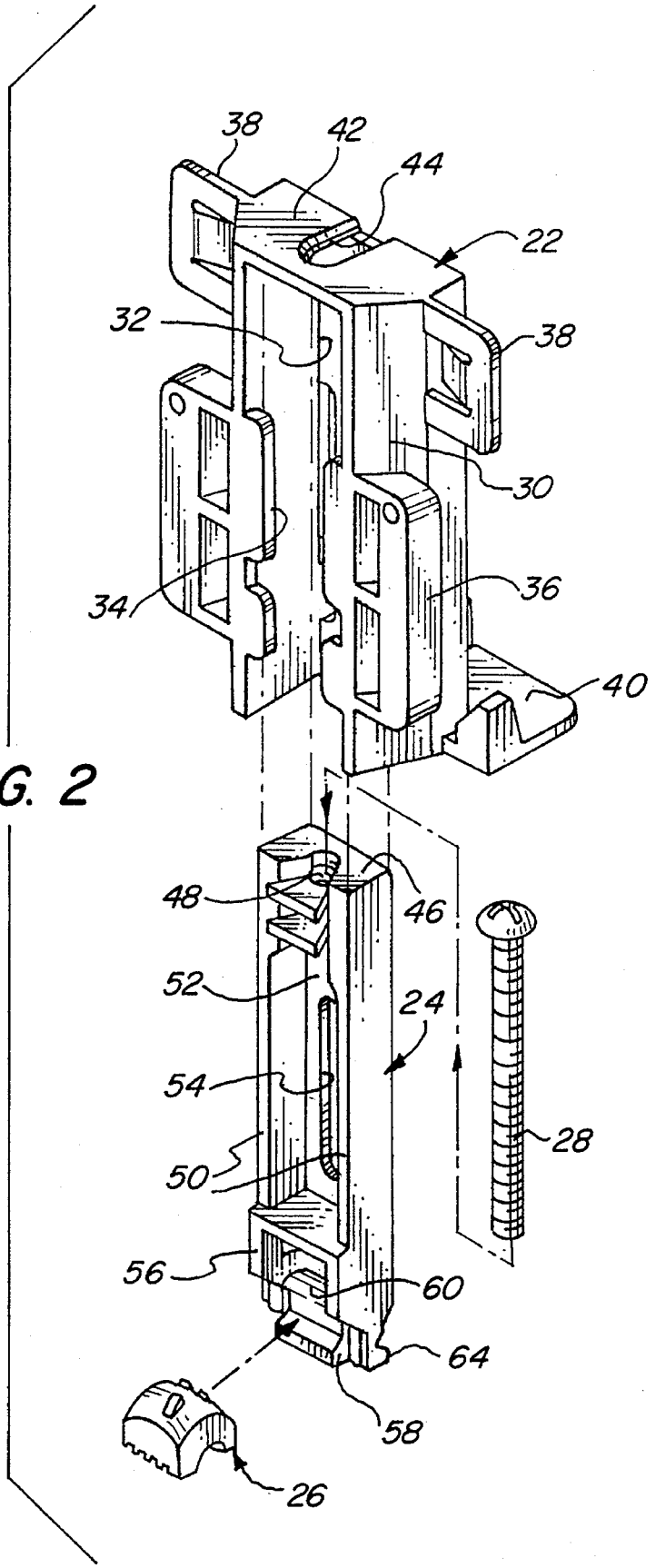
FIG. 2 is an exploded view of the bottom door slide of FIG. 1.
Figure 4:
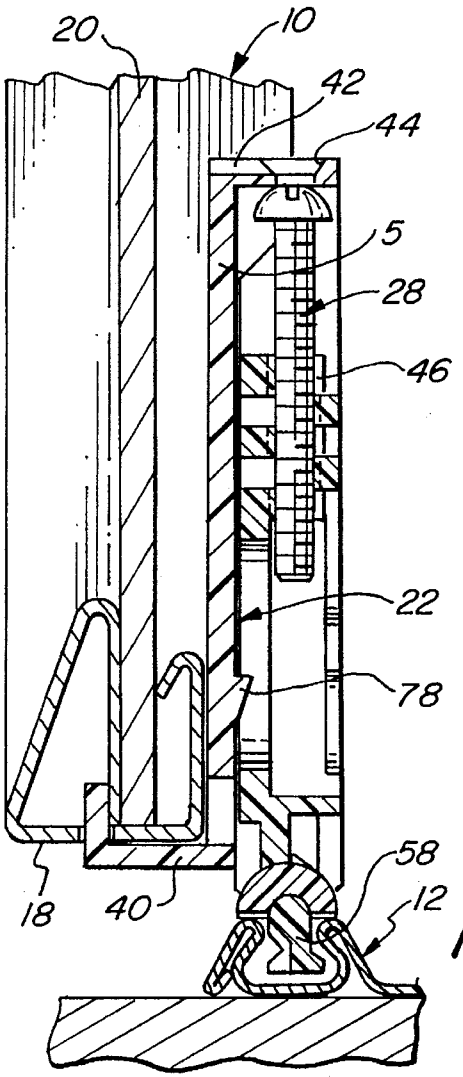
FIG. 4 is a sectional view along the line 4—4 of FIG. 3.
Figure 3:
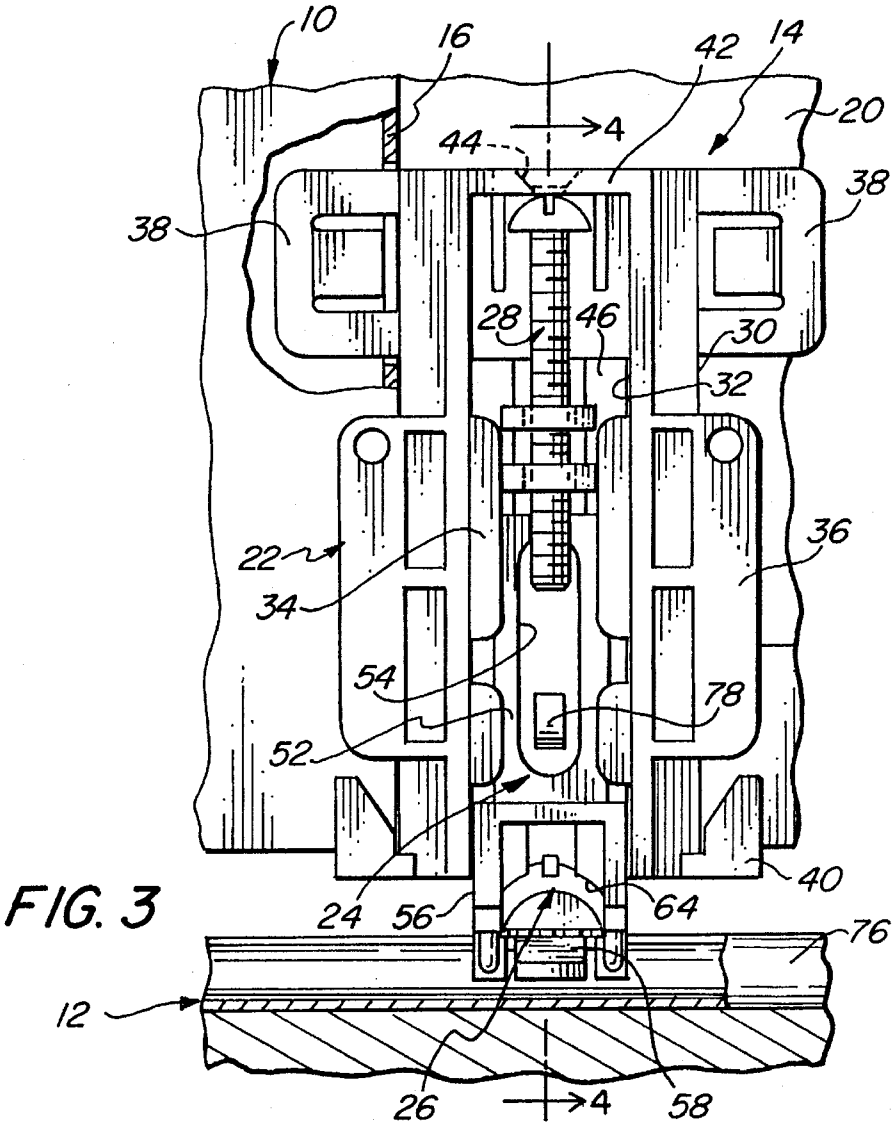
FIG. 3 is a rear elevational view of the door assembly in FIG. 1 with the floor and track in partial section.
Figure 6:
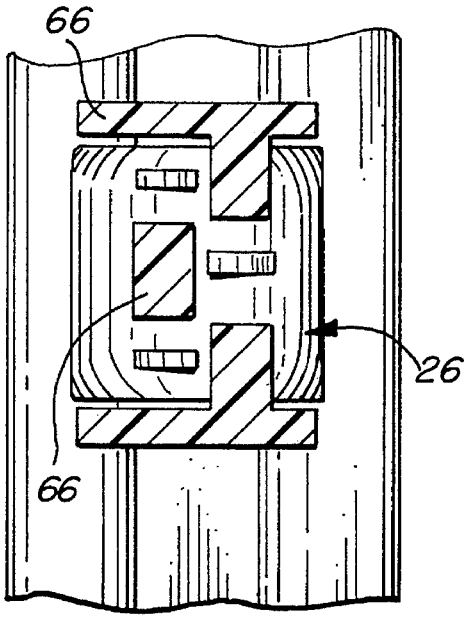
FIG. 6 is a sectional view along the line 6—6 of FIG. 5.

As seen in FIGS. 2–4, the bracket has a body 30 providing a channel 32 which is open at the lower end thereof, and inwardly extending lips 34 on the side walls extend over the channel 32 so as to retain the body 30 are outwardly extending side clips 38, one of which extends into a slot in the stile 16 so as to effect engagement therewith. Intermediate the length thereof are the side flanges 36 which also serve a mounting function but not in the illustrated assembly. Extending across the lower end of the body 30 is a bottom flange 40 which seats the bottom rail 18. At the upper end of the body 30, is a top wall 42 which is provided with an aperture 44 for a purpose to be described more fully hereinafter.

Figure 5:
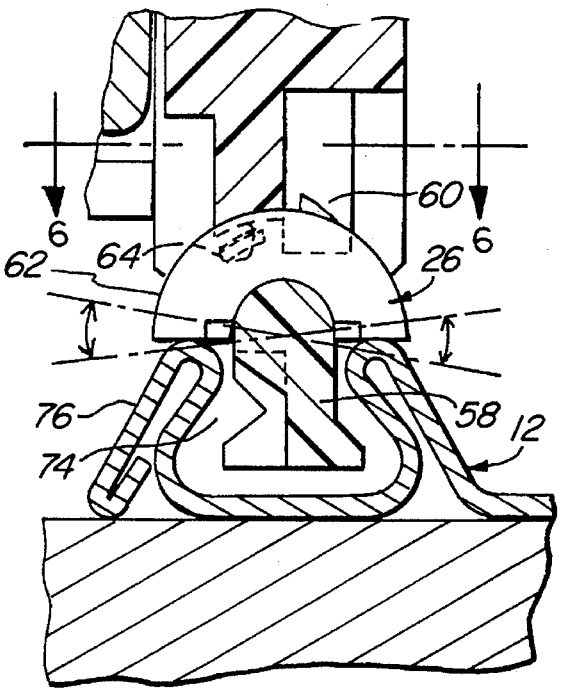
FIG. 5 is a fragmentary sectional view of the floor track and lower portion of the door slide of the present invention and drawn to an enlarged scale and schematically illustrating rotation of the block transversely of the track.
Figure 7:
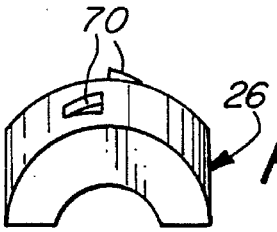
FIG. 7 is an elevational view looking at the side of the slide block of the bottom slide of the present invention.

Turning next to the slide guide 24, it has a top portion 46 with an aperture 48 therein, side walls 50 and a base wall 52 having a vertically extending channel 54 therein. Depending from the base wall 52 is a bottom portion 56 terminating in a depending guide portion 58 which snaps into the channel 74 of the floor track 12 so as to prevent inadvertent disengagement as best seen in FIG. 5. The bottom portion 56 is configured to provide a recess 60 with an arcuate upper surface 62 and bosses providing guide surfaces 64 at the lower ends of the projection 66.

The slide block 26 is of generally C-shaped configuration with the surface of the upper portion (or back of the C) having an arcuate contour along orthogonal axes, i.e., it is generally spheroidal. The back also has bosses 70 which limit movement of the slide block 26 in the recess 60. The ends of the slide block have rib surfaces 71 which slide upon the upper ends of the walls 76 of the track 12.

In the illustrated embodiment, the bottom door slide functions not only as the bottom guide for the door but also as a means for assembling the stiles and rails so as to retain the mirror panel therewithin. Conveniently, the bracket is first assembled with the elements of the door frame and door panel to effect their assembly. The slide guide with the slide block mounted therein may be subsequently inserted thereinto so that the assembled door can be shipped without the slide guide inserted therein. This will minimize the potential for damage during shipment and handling, and facilitate packaging.

As indicated in FIGS. 2 and 3, the slide block 26 is assembled into the recess of the slide guide 24 by simply inserting it into the recess 60 from one side and pushing it transversely of the slide guide 24 until it seats in place. At this location, the slide block is retained in position by the bosses 70. The slide glide 24 is then slid upwardly into the channel 32 of the bracket 22 with some resilient deformation taking place until the boss 78 on the transverse wall of the body 30 of the bracket 22 snaps into the channel 54 in the base wall 52 of the slide guide 24. At this point, the slide guide 24 is now retained in assembly within the bracket 22 and is limited in its motion outwardly of the bracket. It is firmly returned within the bracket 22 by the boss 34. To limit the amount of movement of the slide guide 24 upwardly within the bracket 22, the screw 28 which is seated in the aperture 48 in the top portion 46 of the slide guide 24 may be adjusted. The tip of a screwdriver blade (not shown) is inserted through the aperture 44 in the top wall 42 of the bracket 22, and into the recess of the screw 28 to effect its rotation to vary the length of the shank of the screw 28 projecting upwardly from the slide guide 24 and thereby limit the amount of its upward movement in the channel 32. This then controls the amount of the guide which will project below the door under its load.

As illustrated in FIG. 5, the slide block 26 is slidable rotatably in a direction transversely of the guide within the recess 60 so that its two end surfaces seat firmly upon the upper ends of the side walls 76 of the track 12. This corrects for any misalignment or variations in floor surface, and providing smooth gliding for the door 10 along the length of the track 12.

Figure 10:
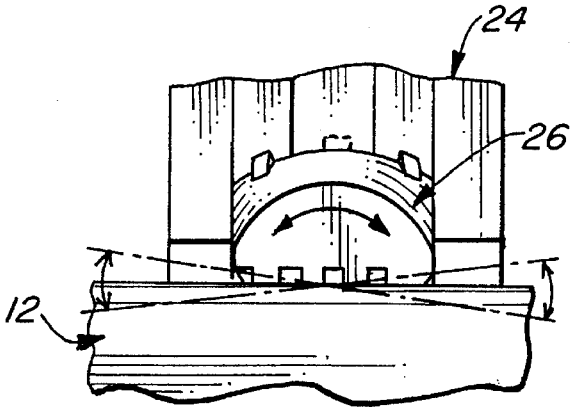
FIG. 10 is a fragmentary elevational view showing the slide block schematically rotating in the longitudinal direction of the track.
Figure 8:
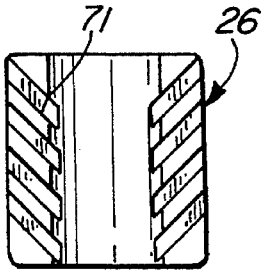
FIG. 8 is a bottom view of the slide block.
Figure 9:
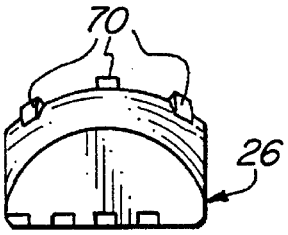
FIG. 9 is an elevational view looking at the front of the slide block.

As seen in FIG. 10, the slide block 26 is also free to slide rotatably within the recess 60 in a direction extending horizontally of the slide guide 24 and thus accommodate an angle of incline for the track which may result from floor distortion or settling of a house.

This rotational movement along orthogonal axes may be described as partially spherical or spheroidal as the upper portion or back of the C-shaped block has a surface which is generally spheroidal.

As will also be seen, the depending guide portions 58 on the bottom of the slide guide 24 extend within the channel 74 of the track 12 so as to prevent the door from moving excessively in either direction transversely of the track and to prevent inadvertent disengagement.

In the illustrated embodiment, the bracket has been molded from synthetic resin. However, other configurations may also be provided which enable the use of metal to form the bracket. Ideally, to minimize friction and to facilitate manufacture, the slide guide is molded from synthetic resin having high lubricity characteristics such as polyamides and polypropylenes. Similarly, the slide block is molded with the desired contours from a synthetic resin having high lubricity such as polyoxymethylene.

Thus, it can be seen from the foregoing detailed description and the accompanying drawings that the bottom door slide of the present invention is one which affords facile accommodation of variations in the floor surface and deviation from parallelism and maintains a smooth sliding motion of the bottom of the door along the floor track. The bottom door slide is easily assembled from components which can be readily and economically fabricated.

Having thus described the invention, what is claimed is:

1. A bottom door slide comprising:

(a) a bracket having mounting portions for mounting on a door and providing a channel opening at the lower end of the bracket;

(b) a slide guide slidably seated in said channel of said bracket and having a guide portion extending below said bracket and having a lower end adapted to extend within an upwardly opening channel of an associated floor track, said guide portion providing a mounting recess spaced upwardly from said lower end and having an upper surface; and (c) a slide block having an arcuate upper surface abutting said upper surface of said mounting recess and a lower surface adapted to ride on the upper end of the floor track, said slide block being slidable on said upper surface of said recess to align itself on the upper end of the floor track.

2. The bottom door slide in accordance with claim 1 wherein said upper surface of said recess is arcuate.

3. The bottom door slide in accordance with claim 1 wherein said block is slidable both horizontally and transversely of said slide guide to enable alignment in a direction transversely of the track and in a direction longitudinally of the track.

4. The bottom door slide in accordance with claim 3 wherein said upper surface of said block is arcuate along orthogonal axes.

5. The bottom door slide in accordance with claim 4 wherein said recess is arcuate along one horizontal axis of said slide guide and said slide guide provides bearing surfaces for said slide block in an axis perpendicular to said horizontal axis to enable pivoting of said slide block in orthogonal directions.

6. The bottom door slide in accordance with claim 1 wherein said slide block is generally C-shaped.

7. The bottom door slide in accordance with claim 1 wherein said slide block and slide guide are cooperatively configured to permit said block to be inserted into said recess.

8. The bottom door slide in accordance with claim 1 wherein said slide block is fabricated from a synthetic resin exhibiting low friction.

9. The bottom door slide in accordance with claim 1 wherein there is included means on said slide guide and bracket for retaining said slide guide in said channel.

10. The bottom door slide in accordance with claim 9 wherein there is included means for adjustably spacing said slide guide vertically in said channel relative to said bracket.

11. A bottom door slide comprising:

(a) a bracket having mounting portions for mounting on a door and providing a channel opening at the lower end of the bracket;

(b) a slide guide slidably seated in said channel of said bracket and having a guide portion extending below said bracket and having a lower end adapted to extend within an upwardly opening channel of an associated floor track, said guide portion providing a mounting recess spaced upwardly from said lower end and having an arcuate upper surface; and (c) a slide block having an arcuate upper surface abutting the upper surface of said mounting recess and a lower surface adapted to ride on the upper end of the floor track, said slide block being slidable on said upper surface of said recess to align itself on the upper end of the floor track, said block being slidable in a direction horizontally and in a direction transversely of said slide guide to enable alignment in a direction transversely of the track in a direction longitudinally of the track.

12. The bottom door slide in accordance with claim 11 wherein said upper surface of said block is arcuate along orthogonal axes.

13. The bottom door slide in accordance with claim 12 wherein said recess is arcuate along one horizontal axis of said slide guide and said slide guide provides bearing surfaces for said slide block in an axis perpendicular to said horizontal axis to enable pivoting of said slide block in orthogonal directions.

14. The bottom door slide in accordance with claim 11 wherein said slide block is generally C-shaped, and said slide block and slide guide are cooperatively configured to permit said block to be inserted into said recess.

15. The bottom door slide in accordance with claim 11 wherein said slide block is fabricated from a synthetic resin exhibiting low friction.

16. The bottom door slide in accordance with claim 11 wherein there is included means on said slide guide and bracket for retaining said slide guide in said channel.

17. The bottom door slide in accordance with claim 16 wherein there is included means for adjustably spacing said slide guide vertically in said channel relative to said bracket.

* * * * *